US010596480B1

(12) United States Patent
Samo et al.

(10) Patent No.: US 10,596,480 B1
(45) Date of Patent: Mar. 24, 2020

(54) BUILDING COMPONENTS

(71) Applicant: Mattel, Inc., El Segundo, CA (US)

(72) Inventors: Jebraeil Samo, Rowland Heights, CA (US); James Franklin Elliott, La Crescenta, CA (US)

(73) Assignee: Mattel, Inc., El Segundo, CA (US)

( * ) Notice: Subject to any disclaimer, the term of this patent is extended or adjusted under 35 U.S.C. 154(b) by 31 days.

(21) Appl. No.: 15/295,125

(22) Filed: Oct. 17, 2016

Related U.S. Application Data

(63) Continuation of application No. 14/082,946, filed on Nov. 18, 2013, now Pat. No. 9,480,931.

(60) Provisional application No. 61/727,211, filed on Nov. 16, 2012.

(51) Int. Cl.
*A63H 33/08* (2006.01)

(52) U.S. Cl.
CPC ..... *A63H 33/086* (2013.01)

(58) Field of Classification Search
CPC ..... A63H 33/086
See application file for complete search history.

(56) References Cited

U.S. PATENT DOCUMENTS 604,708 A * 5/1898 Burton ..... A63H 33/105 446/122
858,090 A * 6/1907 Meineoke ..... A63H 3/16 446/99
1,271,180 A 7/1918 Lavanchy
1,281,492 A * 10/1918 Blamfield ..... A63H 3/16 446/97
2,061,510 A * 11/1936 Drumpelmann ..... A63H 33/062 446/115
2,095,700 A 10/1937 Heede
2,119,921 A * 6/1938 Levy ..... A63H 33/062 446/116
2,499,898 A * 3/1950 Anderson ..... A44B 18/0053 24/442
2,775,093 A * 12/1956 Kundert ..... A44C 5/102 59/80

(Continued)

FOREIGN PATENT DOCUMENTS

EP 621062 A2 * 10/1994
JP 05293256 A 11/1993
JP 10156057 A 6/1998

OTHER PUBLICATIONS

Messerschmitt, Machine Translation of EP0621062-A2, uploaded Jul. 22, 2019, EPO, 23 pages.*

*Primary Examiner* — Eugene L Kim
*Assistant Examiner* — Matthew B Stanczak
(74) *Attorney, Agent, or Firm* — Edell, Shapiro & Finnan, LLC

(57) ABSTRACT

A toy building component is disclosed. The toy building component includes a first body portion formed from soft, flexible material and a second body portion formed from a hard, resilient material that is coupled to the first body portion. One of the first body portion and the second body portion comprises a mounting component that extends from the other of the first body portion and the second body portion, and the other of the first body portion and the second body portion forms a protective casing around the toy building component. The different materials have different properties, and in some embodiments, different colors. The portions may be co-molded together to form the building component.

13 Claims, 9 Drawing Sheets

(56) References Cited

U.S. PATENT DOCUMENTS 2,791,868 A * 5/1957 Viken ..... A63H 33/062 446/107
2,845,748 A * 8/1958 Derham ..... A63H 3/04 446/368
2,885,822 A * 5/1959 Onanian ..... A63H 33/101 446/121
2,943,415 A * 7/1960 Viken ..... A63H 33/088 446/116
3,067,536 A * 12/1962 Brittsan ..... G09F 7/06 40/615
3,206,888 A * 9/1965 Litzka ..... A63H 33/08 446/107
3,242,610 A * 3/1966 Christiansen ..... A63H 33/086 446/128
3,266,113 A * 8/1966 Flanagan, Jr. ..... A44B 18/0053 24/452
3,365,757 A * 1/1968 Billarant ..... A44B 18/0015 24/442
3,452,989 A * 7/1969 Jernstrom ..... A63H 33/108 273/276
3,496,670 A 2/1970 Sloop et al.
3,501,814 A * 3/1970 Anderson ..... A01K 27/001 24/16 PB
3,574,968 A * 4/1971 Schlau ..... A63H 9/00 446/97
3,594,940 A 7/1971 Yonezawa
3,603,025 A * 9/1971 Heubl ..... A63H 33/06 446/94
3,603,026 A * 9/1971 Kishigami ..... A63H 33/108 446/122
3,604,145 A * 9/1971 Zimmerman ..... A63H 33/065 446/108
3,648,404 A * 3/1972 Ogsbury ..... A63H 33/102 446/126
3,657,838 A * 4/1972 Hanning ..... A63H 33/08 446/126
3,672,681 A * 6/1972 Wolf ..... A63F 9/12 273/157 R
3,689,075 A * 9/1972 Adelsohn ..... A63F 9/12 273/157 R
3,777,393 A 12/1973 Baer
3,780,469 A * 12/1973 Hancovsky ..... A63H 33/065 446/127
3,808,648 A * 5/1974 Billarant ..... A44B 18/0053 24/450
3,811,219 A 5/1974 Fischer
3,895,456 A * 7/1975 Fabre ..... A63H 33/062 446/109
3,899,805 A * 8/1975 McMillan ..... A44B 18/0053 24/584.1
3,961,398 A * 6/1976 Herterich ..... A44B 18/0019 24/401
4,030,209 A * 6/1977 Dreiding ..... G09B 23/26 434/278
4,170,082 A * 10/1979 Freedman ..... A63H 33/101 206/504
4,185,410 A 1/1980 Kristiansen
4,209,934 A 7/1980 Ogawa
4,214,403 A 7/1980 Knudsen
4,290,174 A * 9/1981 Kalleberg ..... A44B 18/0019 24/444
4,357,744 A * 11/1982 McKenzie ..... E06B 3/667 29/451
4,509,930 A 4/1985 Schweigert et al.
4,556,393 A * 12/1985 Bolli ..... A63H 33/042 446/91
4,581,792 A * 4/1986 Spier ..... A44B 18/0053 24/20 EE
4,606,732 A 8/1986 Lyman
4,685,892 A 8/1987 Gould et al.
4,764,143 A 8/1988 Gat et al.
4,789,369 A 12/1988 Lyman
4,822,315 A 4/1989 Ben-Gal et al.
4,826,464 A 5/1989 Bertrand
4,870,721 A * 10/1989 Cohen ..... A44B 18/0053 24/16 PB
4,874,341 A 10/1989 Ziegler
4,883,440 A * 11/1989 Bolli ..... A63H 33/042 446/91
4,927,402 A * 5/1990 Fables ..... A63F 9/088 446/119
4,959,265 A * 9/1990 Wood ..... A44B 18/008 428/100
5,120,253 A * 6/1992 Gelardi ..... A63H 33/10 446/109
5,209,693 A 5/1993 Lyman
5,212,855 A * 5/1993 McGanty ..... A44B 18/0046 24/452
5,265,557 A * 11/1993 Lovitz ..... A01K 31/12 119/468
5,310,376 A * 5/1994 Mayuzumi ..... A63H 33/04 446/107
5,312,283 A * 5/1994 Lyman ..... A63H 33/08 446/107
D365,857 S * 1/1996 Lyman ..... D21/491
5,538,452 A 7/1996 Kurani
5,545,070 A 8/1996 Liu
5,577,465 A * 11/1996 Cook ..... A01K 1/033 119/28.5
5,634,245 A * 6/1997 Rouser ..... A44B 18/0053 24/452
5,645,463 A 7/1997 Olsen
5,788,555 A * 8/1998 Glynn ..... A63H 33/10 446/124
5,810,639 A 9/1998 Liu
5,846,113 A * 12/1998 Nielsen ..... A63H 33/086 446/85
5,916,006 A * 6/1999 Ganson ..... A63H 33/00 446/107
5,927,297 A * 7/1999 Cooper ..... A45D 8/36 132/213.1
5,983,467 A * 11/1999 Duffy ..... A44B 18/0046 24/442
5,987,706 A * 11/1999 Boe ..... B65D 63/1018 24/16 PB
6,132,276 A * 10/2000 Leemon ..... B63B 7/04 441/129
6,176,757 B1 1/2001 Lin
6,322,414 B1 * 11/2001 Lin ..... A63H 33/10 446/122
6,402,581 B1 * 6/2002 Podgaiz ..... A63H 33/04 403/174
6,461,215 B1 * 10/2002 Kunz ..... A63H 33/042 446/102
6,491,563 B1 * 12/2002 Bailey ..... A63H 33/062 446/120
6,508,690 B2 1/2003 Axelrad
6,554,677 B2 * 4/2003 Leemon ..... A63H 33/008 446/122
6,634,920 B1 * 10/2003 Michaelsen ..... A63H 33/04 446/128
6,648,714 B1 * 11/2003 Kuo ..... A63H 33/065 446/120
6,679,780 B1 * 1/2004 Shih ..... A63F 9/1204 273/156
6,736,691 B1 * 5/2004 Bach ..... A63H 33/101 446/128
D509,625 S * 9/2005 Pena ..... D28/39
6,997,771 B1 * 2/2006 Lucier ..... A63H 33/04 446/108
7,040,949 B2 5/2006 Slocum
7,308,738 B2 * 12/2007 Barvosa-Carter ..... A44B 18/0003 24/442
7,364,487 B2 * 4/2008 Evans ..... A63H 33/008 446/108
7,581,547 B2 * 9/2009 Pena ..... A45D 8/00 132/275

(56) References Cited

U.S. PATENT DOCUMENTS

| | | | | |
|---|---|---|---|---|
| 7,905,757 | B1 * | 3/2011 | Stapleton | A63H 33/04 446/124 |
| 8,375,529 | B1 * | 2/2013 | Duffy | A44B 18/0053 24/452 |
| 8,387,330 | B2 * | 3/2013 | Wallner | B23B 5/163 403/169 |
| 8,403,723 | B1 * | 3/2013 | Haner | A63H 33/08 446/120 |
| 8,875,356 | B2 * | 11/2014 | Zerfas | A44B 18/0007 24/114.6 |
| 9,480,931 | B1 * | 11/2016 | Samo | A63H 33/065 |
| 2004/0219336 | A1 * | 11/2004 | Sano | C09J 7/403 428/195.1 |
| 2005/0212182 | A1 * | 9/2005 | Yokoyama | B29C 33/40 264/496 |
| 2007/0178799 | A1 * | 8/2007 | Rudell | A63H 33/101 446/120 |
| 2007/0264901 | A1 * | 11/2007 | Sisamos | A63H 33/062 446/90 |
| 2008/0241502 | A1 * | 10/2008 | Giselbrecht | B01D 67/0032 428/313.5 |
| 2009/0106953 | A1 * | 4/2009 | Wittig | A44B 18/0003 24/442 |
| 2009/0126166 | A1 * | 5/2009 | Tuma | A44B 18/0065 24/452 |
| 2010/0210172 | A1 * | 8/2010 | Worthington | A63H 33/086 446/124 |
| 2011/0151743 | A1 * | 6/2011 | Munch | A63H 33/042 446/91 |

* cited by examiner

BUILDING COMPONENTS

CROSS-REFERENCE TO RELATED APPLICATION

This application is a continuation of U.S. Non-Provisional patent application Ser. No. 14/082,946, filed Nov. 18, 2013, entitled "Building Components," which claims the benefit of U.S. Provisional Patent Application No. 61/727,211, filed Nov. 16, 2012, entitled "Flexible Building Structure." The entire disclosure of each of the above-identified U.S. patent applications is incorporated by reference herein in its entirety.

FIELD OF THE INVENTION

The present invention relates to a structure that can be used to form or construct an arrangement of objects, and in particular, relates to a flexible structure to which objects can be coupled. The present invention also relates to building components that have multiple portions that are formed of different materials that enable different functionality for the building components.

BACKGROUND OF THE INVENTION

Children use a structure and one or more objects that can be coupled to the structure to form different designs and arrangements of the objects. Some conventional structures that can be used for building arrangements are rigid in design and are generally planar. The planar, rigid configuration of such conventional structures limits the variation of play and construction that can occur.

Toy building components, and in particular toy building components with coupling portions, are well known and widely popular among children. Typically, the coupling portions of toy building blocks or components include projecting portions on one side of the block and apertures or receptacles that are sized to receive the projecting portions on another, possibly opposite, side so that a user may stack or build multiple blocks or components on each other. Generally, the projecting portions of a first block are inserted into the apertures or receptacles of a second block in order to stack or build the blocks or building components on one another. In particular, many projecting portions are frictionally fit between the side of a building component and an interior wall. Due to this, many building components can only be coupled together or decoupled from each other when the projecting portions are exactly aligned with the aperture or opening between the exterior and interior walls. Accordingly, toy building components that allow building components to be stacked, even when not perfectly aligned, are desired.

Additionally, while sets of building components often include many different colored blocks, each block is typically uniformly colored. One way to create a structure or creation with multiple colors is to mix and match building components of different colors. Conventional building components are made out of a single material and, thus, do not provide any tactile play value. Accordingly, building components which include multiple portions of different colors and/or materials are desired.

Therefore, there is a need for a structure that can be used to provide different ways of play. In addition, there is a need for a flexible structure that can be used with one or more types of toy building objects, such as toy building components. Also, there is a need for building components that have different properties due to different materials.

SUMMARY OF THE INVENTION

The present invention is directed to a construction or building assembly that can be used to build or form any type of desired arrangement of one or more objects on a structure. In one embodiment, the structure is a flexible piece of material that can be manipulated into a desired shape or configuration. The flexible piece of material includes one or more connectors to which objects can be coupled. In various embodiments, the objects may be toy construction pieces, such as blocks, bricks, or other shaped items.

In one embodiment, the present invention is directed to a construction or building assembly that comprises a structure including a base and a plurality of mounting components coupled to and extending outward from the base, the mounting components being spaced apart from each other, the base being flexible so that the base remains in a non-planar configuration; and a plurality of objects coupleable to the structure, each of the objects being configured to engage at least one of the mounting components to couple the particular object to the base.

In an alternative embodiment, each of the mounting components is substantially rigid.

In an alternative embodiment, the mounting components are co-molded with the base such that the base is formed with the connectors placed in their desired positions relative to the base prior to the base being formed.

In an alternative embodiment, the mounting components are formed of a different material than the base.

In an alternative embodiment, the base is sufficiently flexible so that the base is configured in a substantially cylindrical configuration.

In an alternative embodiment, a first mounting component and a second mounting component are coupled to each other via an elongate member.

In an alternative embodiment, the elongate member includes a first end coupled to a first mounting component and a second end opposite the first end, the second end being coupled to the second mounting component.

In an alternative embodiment, the elongate member includes a living hinge formed therein.

In an alternative embodiment, the elongate member is located within the base.

In an alternative embodiment, each of the first mounting component and the second mounting component includes a connecting portion extending from the base and a base portion coupled to the connecting portion, the base portion of each of the mounting components being larger than the corresponding connecting portion.

In another embodiment of the present invention, a construction assembly comprises a support structure including a base and a plurality of mounting components coupled to and extending outward from the base, the mounting components being spaced apart from each other, the mounting components being formed from a different material than the base; and a plurality of objects coupleable to the building structure, each of the objects being configured to engage at least one of the mounting components to couple the particular object to the base.

In an alternative embodiment, the base is flexible and foldable and the mounting components are substantially rigid.

In another embodiment of the present invention, a building assembly comprises a support structure including a base having an upper surface and a lower surface, the base being formed of a flexible material that allows the base to be curved, bent, and rolled; and at least two mounting components coupled to and extending outward from one of the upper surface or the lower surface of the base, the mounting components being spaced apart from each other and configured so that an object can be coupled to at least one of the mounting components to couple the object to the base.

In an alternative embodiment, the mounting components are formed of a rigid material, and are coupled to the base.

In an alternative embodiment, the mounting components are co-molded with the base.

According to one exemplary embodiment of the present invention, a toy building block includes a main body that includes a top and a bottom, at least one projecting portion extending from the top of the main body, and at least one aperture included in the bottom that is configured to securely receive the projecting portion therein. The main body is formed from a first material having a first color and the at least one projecting portion is formed from a second material having a second color. In an alternative embodiment, the materials may have the same color, but have different properties due to the different materials. For example, one material may be hard and one material may be flexible and relatively soft.

According to another exemplary embodiment of the present invention, a toy building block includes a main body including a top and a bottom and a sleeve formed around the main body. The main body is formed from a first material having a first color and a first set of properties and includes at least one projecting portion extending from the top of the main body and at least one receptacle included in the bottom. The at least one receptacle is configured to securely receive the post therein. The sleeve is formed from a second material having a second color and a set of properties different than the first set of properties.

According to some embodiments of the above toy building block, the first material is a hard, resilient material and the second material is a soft, flexible material. However, according to other embodiments of the above toy building block, the first material is a soft, flexible material and the second material is a hard, resilient material.

According to yet another exemplary embodiment of the present invention, a toy building block includes a first portion formed from a first material and a second portion formed from a second material and the first and second portions are co-molded together in order to form the toy building block. The first and second portions include a main body including a top and a bottom, at least one projecting portion extending from the top of the main body, and at least one aperture included in the bottom, the at least one aperture being configured to securely receive the projecting portion therein.

BRIEF DESCRIPTION OF THE DRAWINGS

Like reference numerals have been used to identify like elements throughout this disclosure.

DETAILED DESCRIPTION OF THE INVENTION

Figure 1:
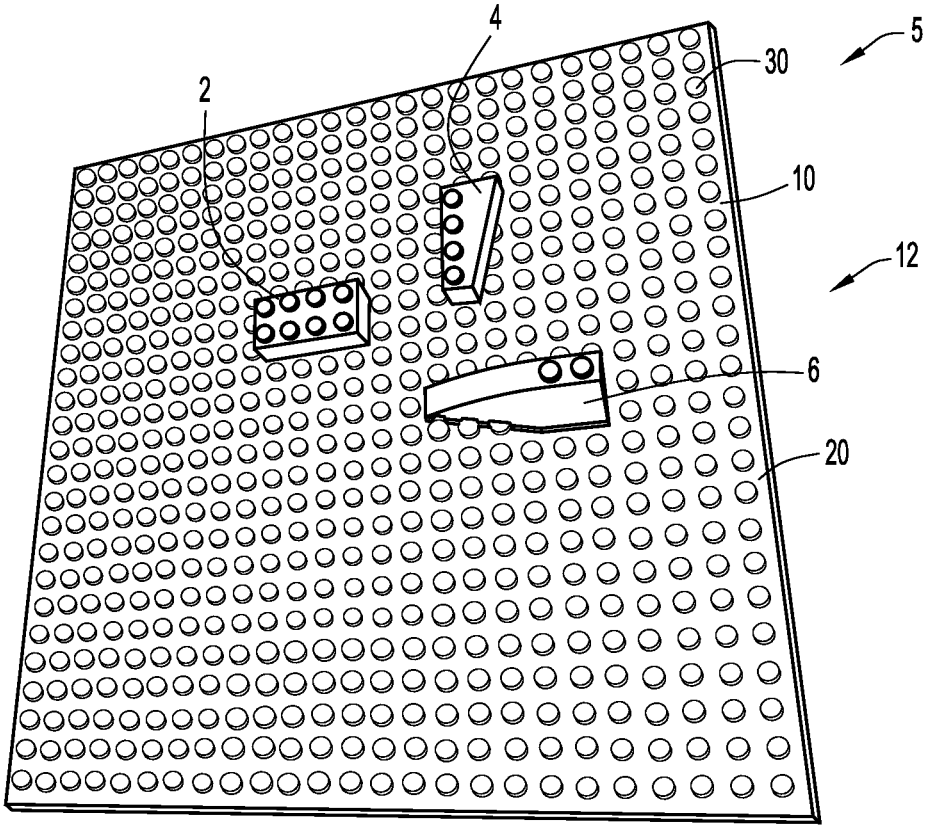
FIG. 1 illustrates a perspective view of an embodiment of a structure according to the present invention in a first orientation.

The terms "structure," "building structure," or "support structure" are used interchangeably herein to refer to any item to which an object can be coupled. The terms "building" and "support" as used with structure include the placement of one or more objects into engagement with and/or coupling them to the underlying structure. As described herein, the structure according to the invention is flexible and can be placed in a variety of different configurations, positions, and orientations. In addition, the structure may be formed so that it has many different shapes defined by the outer perimeter of the structure. The terms "receptacle," "aperture," and "receiving area" may be used alternatively herein.

The term "elongate member" as used herein includes any member or element that has a length. An "elongate member"

can be either flexible or stiff. Also, an "elongate member" can be soft and malleable or a molded article. In various embodiments, an "elongate member" can be linear, substantially curved from end-to-end, or curved at least at one portion therealong, as well as narrow or wide.

Generally referring to the figures, at least one exemplary embodiment of a toy building component is shown. As will be discussed below in further detail, in one embodiment, the toy building component of the present invention includes multiple portions, such as a first portion and a second portion, co-molded together. In some embodiments, the toy building component may include two differently colored portions, but in other embodiments, the toy building component may include portions made of different materials. Additionally, the toy building component of the present invention includes at least one projecting portion and at least one aperture or receptacle configured to receive a projecting portion or post included on another component.

Still generally referring to the figures, the figures of the present application illustrate various embodiments of building components according to the present invention. In various embodiments, the quantity of posts on a building component can vary, depending on the shape and size of the building component. It is to be understood that any desirable arrangement of posts may be included on a building component. The posts may be in one or more rows, depending on the width of the building component. For example, the posts may be in a 1 by 6 grid. Alternatively, the posts may be in a 2 by 3 grid or a 6 by 6 grid, depending on the shape.

Similarly, any desirable arrangement or shape of a receptacle or receptacles may also be included on a building component. Preferably, the arrangement and quantity of receptacles on a particular building component mirrors or matches the arrangement of posts on that building component.

The term "building component" is used herein to refer to any article or item with one or more posts and/or on or more receptacles formed therein. The terms "building component" and "block" may be used alternatively. The quantity of posts and receptacles of building components can vary from component to component. In addition, the shape and configuration of the building components can vary as well. The term "building component" is not limited to articles or items which are block-shaped. For example, while one embodiment of a building component according to the present invention is a rectangular parallelepiped, other embodiments of the building component may be flat and/or arcuate. A flat building component may be referred to alternatively as a plate.

Referring to FIG. 1, an embodiment of a building assembly 5 is illustrated. In this embodiment, the building assembly 5 includes a structure 10 to which one or more objects, such as objects 2, 4, and 6, can be coupled. The structure 10 includes a base 20 that has several mounting components or posts 30 extending outwardly therefrom. The base 20 is generally planar in the configuration 12 illustrated in FIG. 1. The mounting components or posts 30 are spaced apart from each other and cover a substantial portion of the base 20. In alternative embodiments, the quantity and location of the mounting components 30 on a base 20 can vary. In addition, while the structure 10 is illustrated with a generally square shape, the shape and size of the structure 10 can vary in different embodiments.

Figure 2:
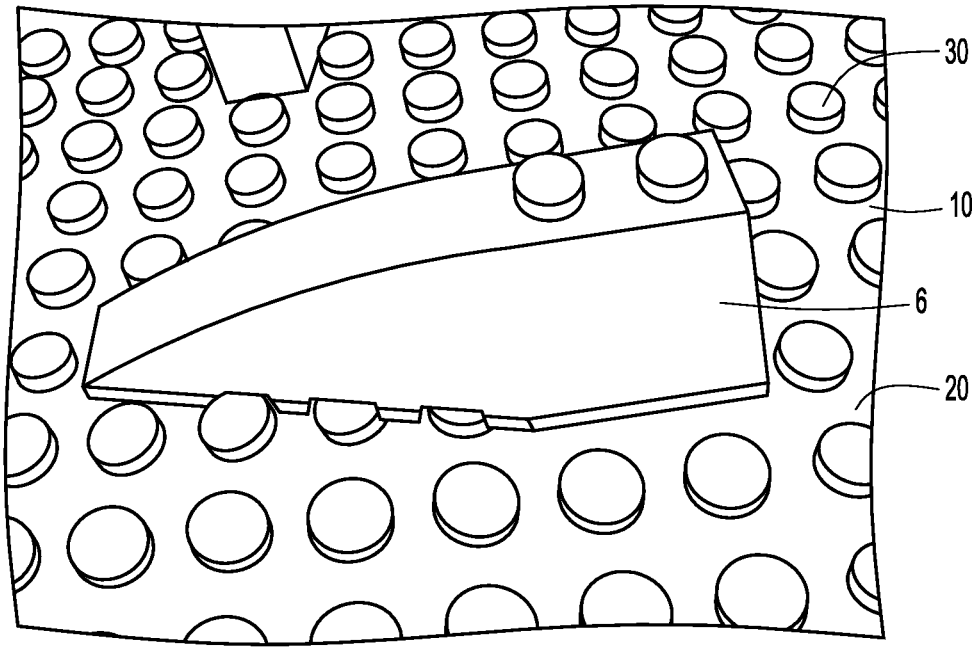
FIG. 2 illustrates a close-up perspective view of the structure of FIG. 1, with an object coupled thereto.

Referring FIG. 2, a close-up perspective view of an object 6 coupled to the base 20 of structure 10 is illustrated. As shown, the object 6 is configured to receive one or more of the mounting components 30 that extend outwardly from the base 20. As will be discussed in greater detail below, the mounting components 30 are formed of a material that is different than the material that is used to form the base 20. The posts 30 are rigid, which allows objects 2, 4, and 6 to be coupled thereto, and the base 20 is flexible, which allows its configuration to be manipulated.

Figure 3:
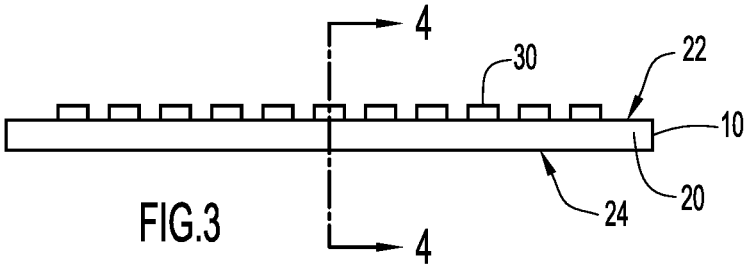
FIG. 3 illustrates a side view of the structure of FIG. 1.

Referring to FIG. 3, a side view of the support structure 10 is illustrated. As shown, the base 20 of the support structure 10 includes an upper surface 22 and a lower surface 24 opposite the upper surface 22. In addition, the base 20 has a generally planar configuration. The extent to which mounting components 30 extend above the upper surface 22 is illustrated.

Figure 4:
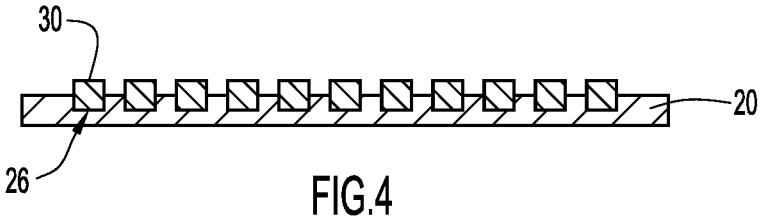
FIG. 4 illustrates a cross-sectional side view of the structure of FIG. 3 taken along the line "4-4."

Referring to FIG. 4, a cross-sectional view of the base 20 is illustrated. In this embodiment, the base 20 includes several recesses or cavities 26 formed therein. In one implementation, the base 20 can be molded so that the recesses 26 are formed in the base 20 during the molding process. In another implementation, the base 20 can be molded without the recesses 26, which can be formed subsequently in the base 20 via a tool or machine.

As shown in FIG. 4, a portion of each of the mounting components 30 is coupled to the base 20. In this embodiment, the mounting components 30 are co-molded to the base 20 so that a sufficient distance of the mounting components 30 extends upwardly from the base 20.

Figure 5:
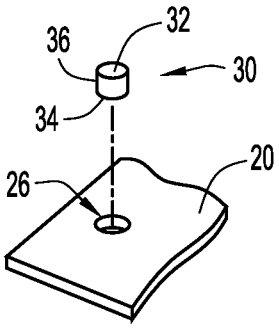
FIG. 5 illustrates an exploded perspective view of a portion of the structure of FIG. 3 showing a mounting component removed from the base of the structure.

Referring to FIG. 5, an exploded perspective view of a mounting component 30 and a portion of the base 20 is illustrated. Mounting component 30 includes an upper end or portion 32, a lower end or portion 34, and an outer surface 36. The outer surface 36 of the mounting component 30 corresponds to the shape of the recess 26 formed in the base 20. While mounting component 30 is illustrated as having a substantially cylindrical configuration, in different embodiments, the mounting component 30 may have a configuration other than cylindrical, such as square, oval, or rectangular.

Figure 8A:
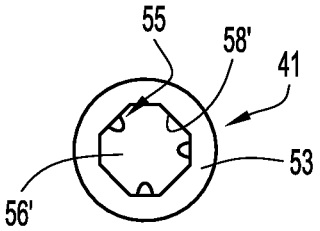
FIG. 8A illustrates a bottom view of an alternative embodiment of a mounting component according to the present invention.
Figure 6:
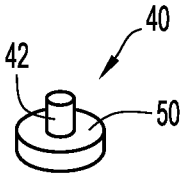
FIG. 6 illustrates a perspective view of another embodiment of a mounting component according to the present invention.
Figure 7:
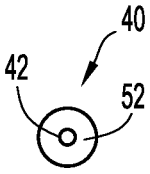
FIG. 7 illustrates a top view of the mounting component of FIG. 6.
Figure 8:
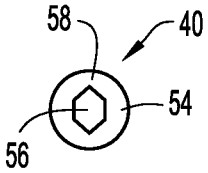
FIG. 8 illustrates a bottom view of the mounting component of FIG. 6.
Figure 9:
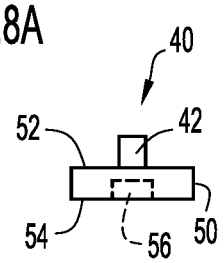
FIG. 9 illustrates a side view of the mounting component of FIG. 6.

Referring to FIGS. 6-9, different views of an alternative embodiment of a mounting component are illustrated. Referring to FIG. 6, mounting component 40 includes a connecting portion 42 to which an object can be coupled and a base 50. In this embodiment, the connecting portion 42 and the base 50 are integrally formed together. As shown in FIGS. 7-9, the base 50 has an upper surface 52 and a lower surface 54. The outer perimeter of the base 50 is larger than the outer perimeter of the connecting portion 42. Thus, as the base 50 of the mounting component 40 is coupled to the base 20 of the support structure 10, all or substantially all of the base 50 is located within the base 20, thereby exposing only part of the connecting portion 42 of the base 40.

Referring to FIGS. 8 and 9, the lower surface 54 of the base 50 includes several walls 58 that collectively define an opening, recess or cavity 56 in the lower surface 54. In this embodiment, there are six walls 58 that form a hexagonal-shaped opening 56. The opening 56 is sized so that it can receive a connecting portion of another mounting component, whether the mounting component is formed with a base similar to base 10 or as part of a different object.

An alternative embodiment of a mounting component is illustrated in FIG. 8A. In particular, a bottom view of the lower surface 53 of the mounting component 41 is shown. In this embodiment, eight walls 58' collectively define a recess or cavity 56'. On one or more of the walls 58' there is a rib or protrusion 55 that extends into the recess 56'. The rib or ribs 55 are engaged by the post or connector portion of a different mounting component. The use of the ribs 55 minimizes the contact between the post and the walls 58'. In alternative embodiments, the quantity of walls 58' can vary and the quantity of ribs 55 can vary.

Figure 10:
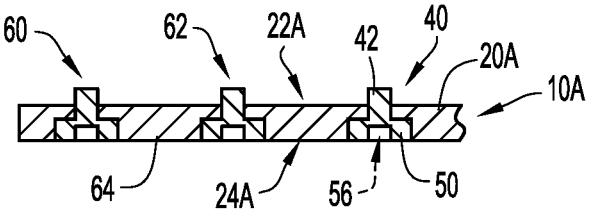
FIG. 10 illustrates a cross-sectional side view of an alternative embodiment of a structure according to the present invention.

Referring to FIG. 10, an alternative embodiment of a building structure according to the present invention is illustrated. In this embodiment, the building structure 10A includes a flexible base 20A to which several mounting components, such as mounting components 40, 60, and 62, are coupled. Referring to mounting component 40, its connecting portion 42 extends outwardly beyond the upper surface 22A of the base 20A. In addition, the recess 56 formed in the lower surface of the base 50 of mounting component 40 is accessible proximate to the lower surface 24A of the base 20A. Thus, other mounting components can engage the recess 56 and be coupled to mounting component 40.

Figure 10A:
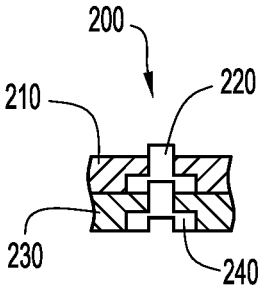
FIG. 10A illustrates a cross-sectional side view of multiple structures coupled to each other according to the present invention.

An assembly 200 of two flexible panels 210 and 230 coupled together is illustrated in FIG. 10A. As shown, the connecting portion or post of connector member 240 is inserted into the receptacle or cavity of connector member 220, thereby coupling the connector members 220 and 240 together.

In other contemplated uses, objects, such as toy construction blocks, with connecting portions or posts can be coupled to the front or upper surface of a base via the connecting portion that extends above the base. Alternatively, such objects can be coupled to the rear or lower surface of a base via the receptacle or cavity portion of a connector member located within the base.

Figure 11:
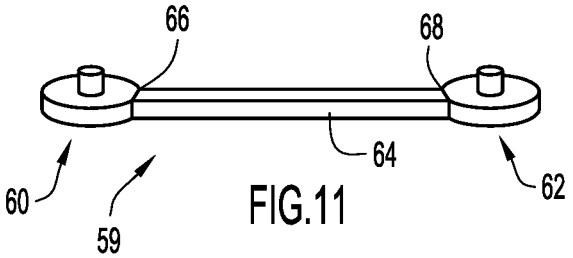
FIG. 11 illustrates a perspective view of an embodiment of a connecting assembly according to the present invention.

Referring to FIG. 11, a perspective view of an embodiment of a mounting component system or assembly is illustrated. In this embodiment, the assembly 59 includes mounting components 60 and 62, which are generally the same as previously described mounting component 40. In addition, mounting components 60 and 62 are coupled to each other via a member 64, which can be referred to alternatively as a structural member or an elongate member. Member 64 has opposite ends 66 and 68 that are coupled to mounting components 60 and 62, respectively. In one implementation, the mounting components 60 and 62, and the member 64 are integrally formed with each other. The member 64 is flexible so that mounting component 60 moves relative to mounting component 62.

Referring back to FIG. 10, the cross-sectional view illustrates mounting components 60 and 62 coupled to base 20A. As shown, member 64 is contained within the base 20A. In one implementation, member 64 is not exposed through the base 20A on the upper surface 22A. In another implementation, member 64 is not exposed through the base 20A on either of the upper surface 22A or the lower surface 22B.

Figure 12A:
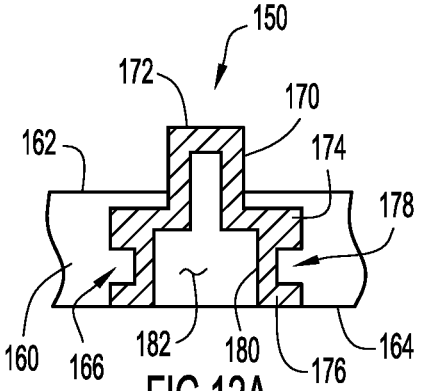
FIG. 12A illustrates a cross-sectional side view of another embodiment of a structure according to the present invention.
Figure 12:
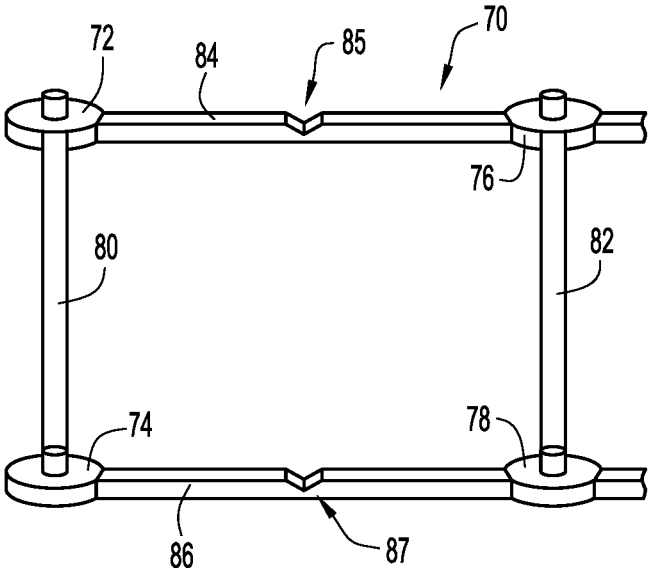
FIG. 12 illustrates a perspective view of another embodiment of a connecting assembly according to the present invention.

Referring to FIG. 12, a perspective view of an alternative embodiment of a mounting component system or assembly is illustrated. In this embodiment, the system 70 includes several mounting components 72, 74, 76, and 78 that are coupled together by elongate members 80, 82, 84, and 86, which connect adjacent mounting components. In different embodiments, the elongate members 80, 82, 84, and 86 can have different structures and configurations. For example, elongate member 84 and 86 are illustrated as having living hinges 85 and 87, respectively, which facilitate the movement of the mounting components relative to each other as the base 20A bends.

Referring to FIG. 12A, another embodiment of a structure according to the present invention is illustrated. In this embodiment, the structure 150 includes a flexible base 160 with an upper surface 162 and a lower surface 164. In addition, the structure 150 includes a connector 170 with a connecting portion 172 that is positioned so that it extends upwardly from the base 160 from the upper surface 162. The connector 170 includes an inner wall 180 that defines a receptacle or chamber 182 into which a connecting portion of a different connector can be inserted.

The connector 170 also includes a mounting portion or body 174 that defines an undercut region or groove 178 with rib or flange 176. As shown, a portion 166 of the flexible base 160 engages and is inserted into the groove 178. This engagement of the flexible base 160 with the groove 178 makes the separation of the connector 170 from the base 160 more difficult than if the connector 170 did not have the groove 178. In an alternative embodiment, an adhesive or other coupling element can be used to couple the inserted portion 166 to the surfaces of the groove 178.

Figure 13:
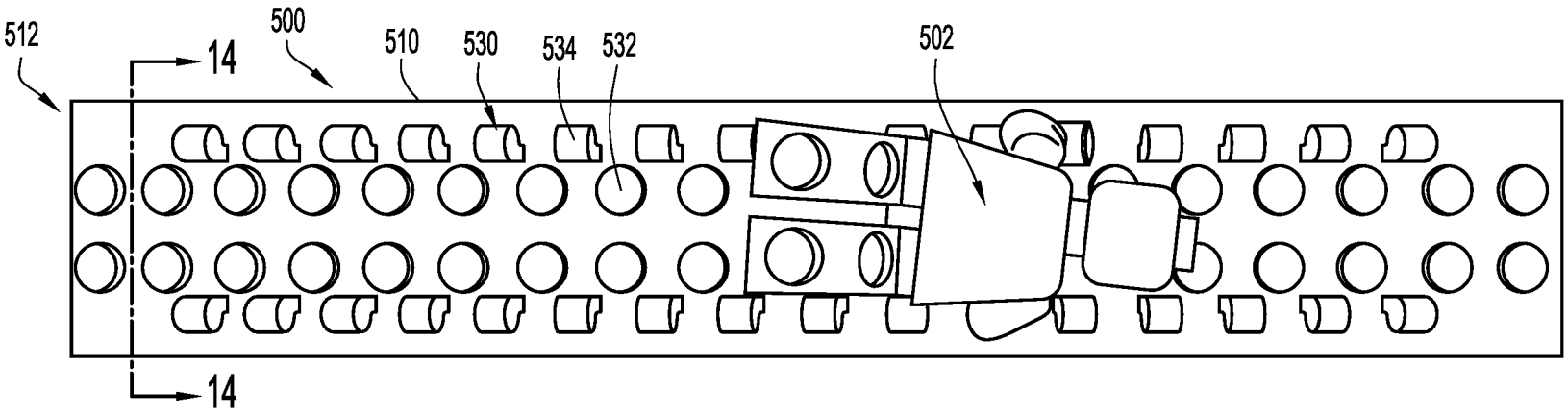
FIG. 13 illustrates a perspective view of another embodiment of a structure according to the present invention in a first orientation.
Figure 14:
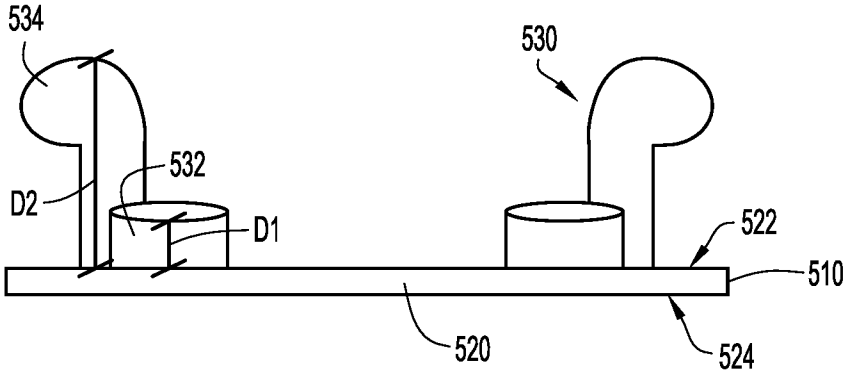
FIG. 14 illustrates a cross-sectional side view of the structure of FIG. 13 taken along the line "14-14."

Now referring to FIGS. 13 and 14, another embodiment of a building assembly 500 is illustrated. In this embodiment, the building assembly 500 includes a structure 510 to which one or more objects, such as object 502, can be coupled. However, it is to be understood that although the illustrated structure 510 has a generally rectangular shape, the shape and size of the structure 510 can vary in different embodiments. The structure 510 includes a base 520 (see FIG. 14) that has several mounting components 530 extending outwardly therefrom and the structure 510 may, similar to structure 10, also be bent, folded or otherwise moved between multiple configurations, as is described below. In the illustrated embodiment, the structure 510 is in a configuration 512 where the base 520 is generally planar.

Additionally, although not shown, in some embodiments, the base 520 may include several recesses or cavities formed therein which may be shaped, sized and formed in accordance with the methodologies and features described above. For example, in one implementation, the base 520 can be molded so that the recesses are formed in the base 520 during the molding process, but in other implementations, the base 520 can be molded without the recesses, and recesses can be formed subsequently in the base 520 via a tool or machine.

Still referring to FIG. 13, the mounting components 530 are spaced apart from each other and cover a substantial portion of the base 520. In this embodiment, mounting components 530 include two types of mounting components: first mounting components 532 and second mounting components 534. The mounting components 530 are configured such that the first mounting components 532 are cylindrical posts and the second mounting components 534 are substantially P-shaped (see FIG. 14). The first mounting components 532 are aligned in two rows longitudinally interior of two rows of the second mounting portions 534 which are aligned along the longitudinal edges of base 520, as viewed in FIG. 13. However, in alternative embodiments, the quantity, size, shape, and location of the mounting components 530 on a base 520 can vary. Regardless, and as discussed below, the mounting components 530 are formed of a material that is different than the material that is used to form the base 520, such that structure 510 provides a flexible base with rigid mounting portions.

Referring to FIG. 14, a cross-sectional view of the base 520 is illustrated. As shown, the base 520 of the support structure 510 includes an upper surface 522 and a lower surface 524 opposite the upper surface 522. Additionally, a portion of each of the mounting components 530 is coupled to the base 520 such that the mounting components 530 extend above upper surface 522. In this embodiment, the mounting components 530 are co-molded to the base 520 so that a sufficient portion of the mounting components 530 extends upwardly from the base 520. More specifically, the first mounting components 532 are co-molded to the base 520 such that they extend a first distance "D1" above the upper surface 522 and the second mounting components 534 are co-molded to the base 520 such that they extend a second distance "D2" above upper surface 522. In this particular embodiment, D2 is larger than D1, such that the second mounting components 534 extend above the first mounting components 532, but in other embodiments, mounting components 530 may extend any desirable distance above base 520.

Figure 15:
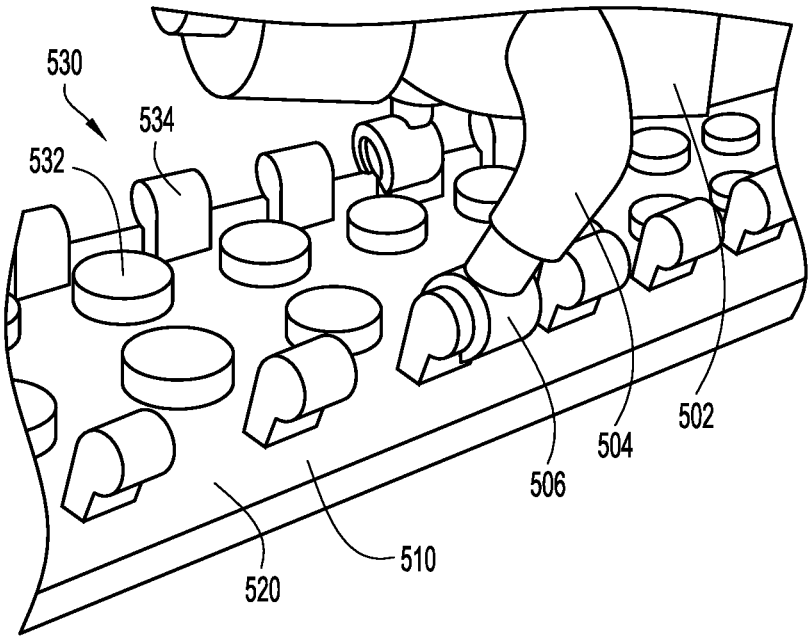
FIGS. 15-16 illustrate close-up perspective views of the structure of FIG. 13, with an object coupled thereto.
Figure 16:
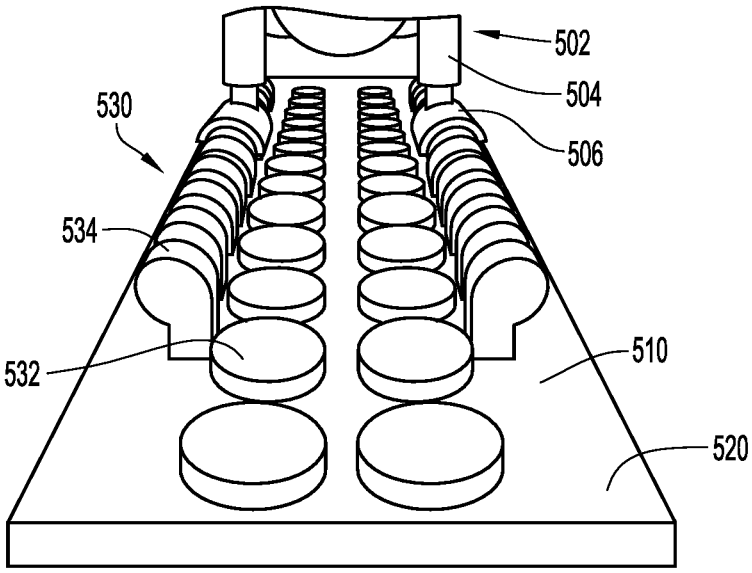

Referring to FIGS. 15-16, a close-up perspective view of an object 502 coupled to the base 520 is illustrated. As shown, the object 502 is configured to receive one or more of the mounting components 530 that extend outwardly from the base 520, such that the object 502 may be releasably secured to structure 510. In this embodiment, the object 502 is shaped as a human figurine and includes appendages 504. At least some of the appendages 504 include receivers 506 at their distal ends and the receivers 506 are configured to receive at least some of the mounting components 530. In particular, the appendages 504 shaped to resemble arms of a figurine may include receivers 506 configured to engage second mounting components 534, such that the object 502 may be coupled to structure 510 so it appears to climb, hang, handstand, or otherwise grab structure 510 with the arms of a figurine, as seen in FIGS. 15-16. However, although not shown, other appendages 504, such as the legs of the figurine, may include receivers 506 configured to receive the first mounting components 532, such that the object 502 may be coupled to structure 510 in a manner which resembles walking, standing, or other similar upright positions or motions.

In order to effectuate the aforementioned couplings, the outer surface of the mounting components 530 may correspond to the interior shape of the receivers 506 included on an object 503. However, in some embodiments, only a portion of the mounting components 530 may correspond to the interior shape of the receivers 506, such that an object may be coupled to structure 510 at a desirable distance from base 520. For example, in the particular embodiment shown in FIGS. 15-16, the interior of receivers 506 corresponds to only the top portion of second mounting components 534, such that the top portion is captured within receivers 506 in order to couple object 502 to structure 510 at a desirable distance from base 520.

Referring generally to the figures included herein, in a preferred embodiment, the base is made of a flexible material that allows the base to be bent, folded, rolled, twisted, and/or otherwise manipulated to have various shapes. Various materials that can be used for the base are Silicone, KRATON, or polyvinyl chloride (PVC). By comparison, the mounting components are made from a substantially rigid material, which allows objects, such as toy construction building components, to be coupled to one or more of the objects, regardless of the configuration and orientation of the base. Various materials that can be used for the mounting components are Acrylonitrile butadiene styrene (ABS) or polypropylene (PP). In some embodiments, the mounting components can be transparent or translucent.

Figure 17:
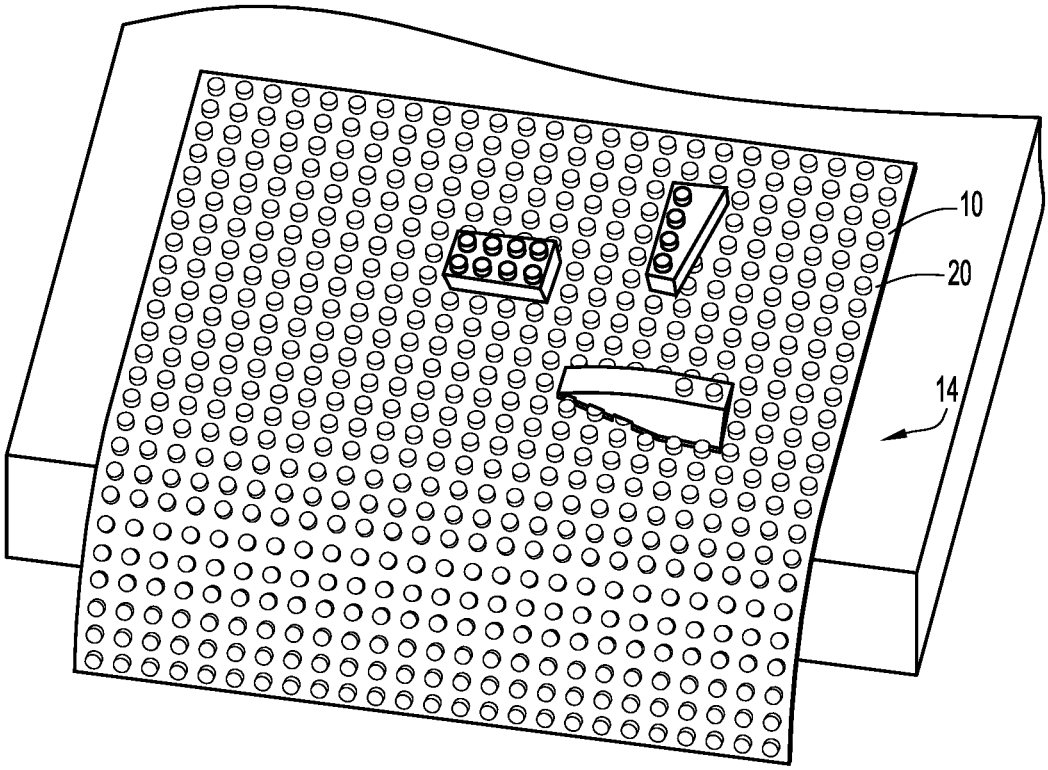
FIG. 17 illustrates a perspective view of the structure of FIG. 1 in a second configuration.
Figure 18:
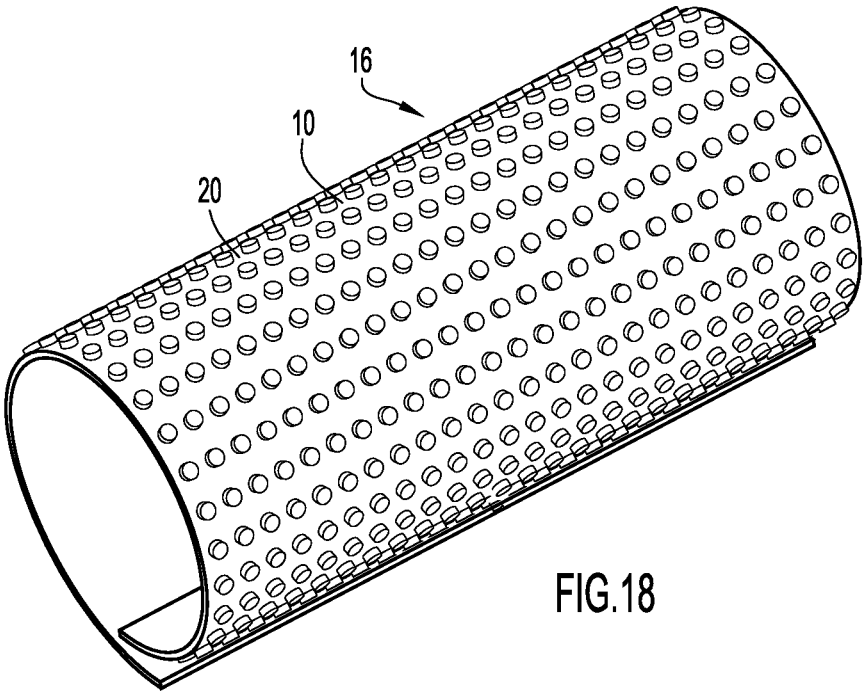
FIG. 18 illustrates a perspective view of the structure of FIG. 1 in a third configuration.

Due to this composition, the structures 10, 510 are flexible but also provide a stable building surface. As an example, in FIG. 17, the building structure 10, and in particular the base 20, is draped over an edge of a table, which causes the flexible base 20 to have a configuration 14 that is curved and is not planar. In addition, referring to FIG. 18, the base 20 is illustrated in another configuration 16 in which it has been rolled into a substantially cylindrical configuration. It is to be understood that any structure within the scope of the present invention, such as structure 510, may also be moved in similar manners to achieve similar configurations.

Referring generally to the figures included herein, the support structures 10, 510 with the flexible base 20, 520 and the mounting components 30, 530 can be used in many different ways. Some exemplary uses of the support structure include, but are not limited to, the support structure being used: in toy construction play, as part of an accessory (such as a backpack); as part of an article of clothing; and/or as part of a toy or other object. By utilizing the mounting components 30, the support structure 10 can have a variety of shaped and configured objects coupled to it in a variety of orientations. Furthermore, in various embodiments, the outer perimeter of the support structure can be triangular, square, circular, rectangular, oval, curved, or any other shape. In still other implementations, hinged objects may be used on a surface of a flexible panel in order to allow greater flexibility when relative movement of the objects, in addition to movement of the panel is desired.

Figure 19:
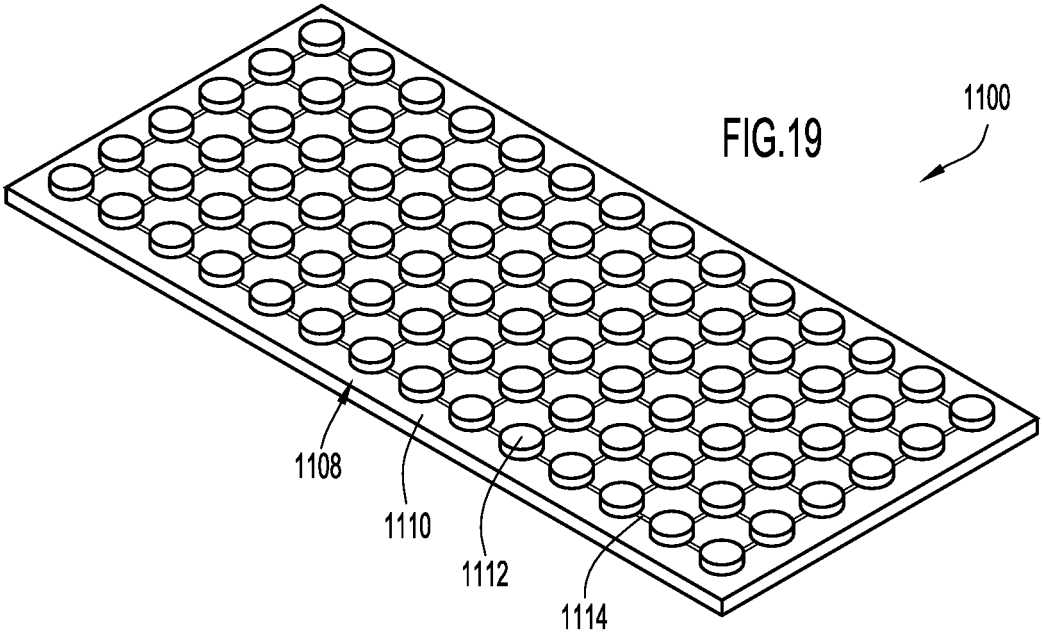
FIGS. 19-20 illustrate top and bottom perspective views, respectively, of an exemplary toy building block in accordance with the present invention.
Figure 20:
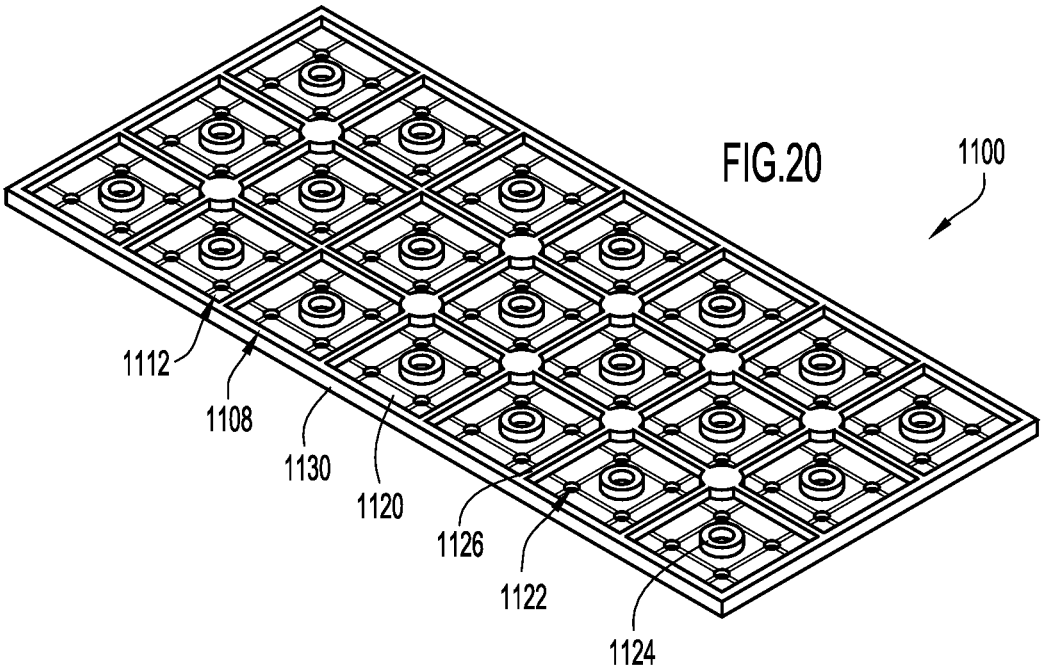

Now turning to FIGS. 19-20, a toy block 1100 is shown from top and bottom perspective views. The toy building component 1100 includes a main body 1108 with a top 1110, a bottom 1120, and an edge 1130 (see FIG. 2) extending around the periphery of both top 1110 and bottom 1120. Additionally, toy building component 1100 includes at least one projecting portion or post 1112 extending from the top 1110 and at least one receiver or aperture 1122 included on bottom 1120. In this particular embodiment, the building component 1100 includes several posts 1112 and receptacles or receiving areas 1122, the quantities and layouts of which can vary in different embodiments. Additionally, in this particular embodiment, each projecting portion 1112 is a cylindrical annulus and the apertures 1122 are formed between at least two interior walls 1124 or at least one interior wall 1124 and at least a portion of edge 1130. However, while the apertures 1122 are merely formed between features of building component 1100 in this embodiment, apertures 1122 may be an additional feature that is included or embedded in bottom 1120, as desired, in other embodiments.

Referring specifically to FIG. 20, the edge 1130 of building component 1100 extends beyond the bottom 1120 and the walls 1124 extend from bottom 1120, such that apertures 1122 are formed between at least two of walls 1124 or at least one wall 1124 and one edge 1130. More specifically, any peripheral apertures 1122 are formed between at least a portion of edge 1130 and at least one of the walls 1124, where peripheral is simply used to denote an aperture adjacent to edge 1130 while internal apertures (i.e. those apertures which are not peripheral apertures) are formed between two walls 1124. In some embodiments, such as the embodiment shown in FIGS. 19-20, edge 1130 may extend further than the walls 1124 such that the walls 1124 appear to be contained within the building component 1100. In other embodiments, however, the walls 1124 may extend beyond the edge 1130, if desired. Regardless, the walls 1124 are spaced a distance apart from each other and from edge 1130 such that each aperture 1122 is sized to receive the projecting portions 1112 of the toy building component 1100.

In fact, in the embodiment shown in FIGS. 19-20, the toy building components 100 include small indentations or cavities in bottom 1120 where the protrusions 1112 are formed on the top 1110, indicating where the apertures 1122 are formed between walls 1124 and between walls 1124 and edge 1130.

Figure 21:
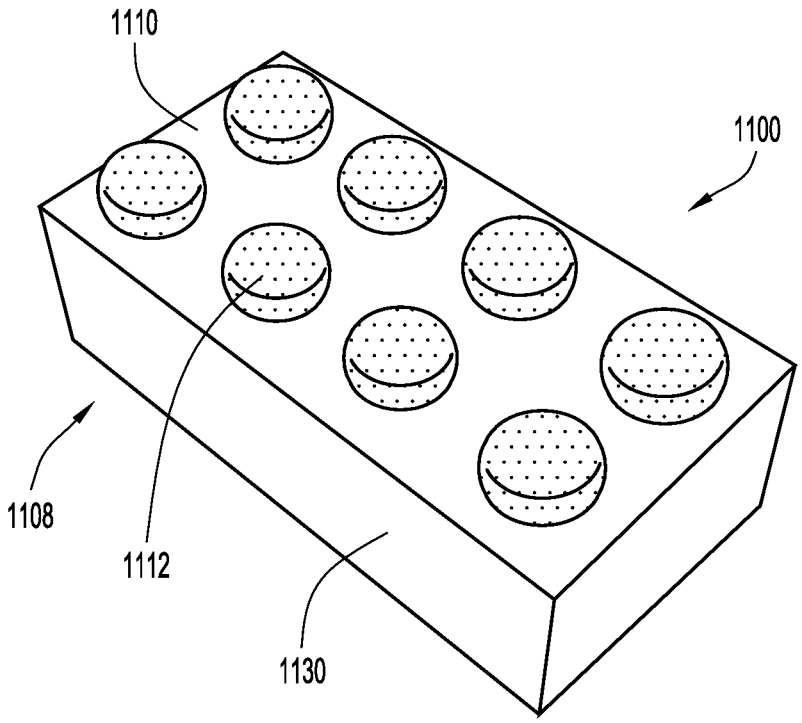
FIG. 21 illustrates a top perspective view of another exemplary toy building block in accordance with the present invention.

Now referring to FIGS. 19-21, regardless of the size and shape of the toy building component 1100, in the embodiments shown in FIG. 19-21, the toy building components 1100 are formed by co-molding the posts 1112 with the remainder of the building component 1100. For example, the posts 1112 may be first be formed of a first material having a first color, perhaps via injection molding, and then the remainder of the building component 1100 (including apertures 1122) may be molded around the projecting portions 1112 from a second material having a second color. In the exemplary embodiments shown in FIGS. 19-20, the first color is white or off-white and the second color is black. The posts may be rubber or plastic and the building component may be plastic.

Accordingly, the connectors 1114 may serve to properly align the projecting portions 1112 while the main body 1108 of the toy building component is formed there around so that, in some embodiments, the connectors 1114 are essentially captured within the main body 1108 of the building component 1100. In these embodiments, the projecting portions 1112 may referred to as a first portion of toy building component 1100 and the remainder of the building component may be referred to as a second portion of toy building component 1100 and while the first and second portions may be different colors, they may each be formed from the same material, such as a rigid plastic. Alternatively, different materials may be used, which change the functionality of the different parts of the building components. A more flexible material allows relative movement of one portion of the building component relative to another portion.

Figure 22:
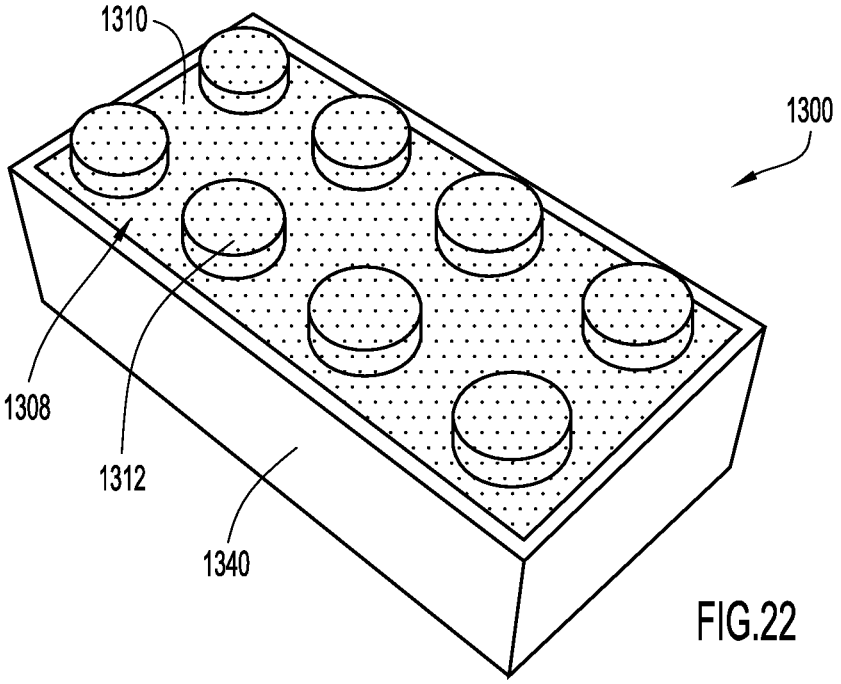
FIGS. 22-23 illustrate top and bottom perspective views, respectively, of another exemplary toy building block in accordance with the present invention.
Figure 23:
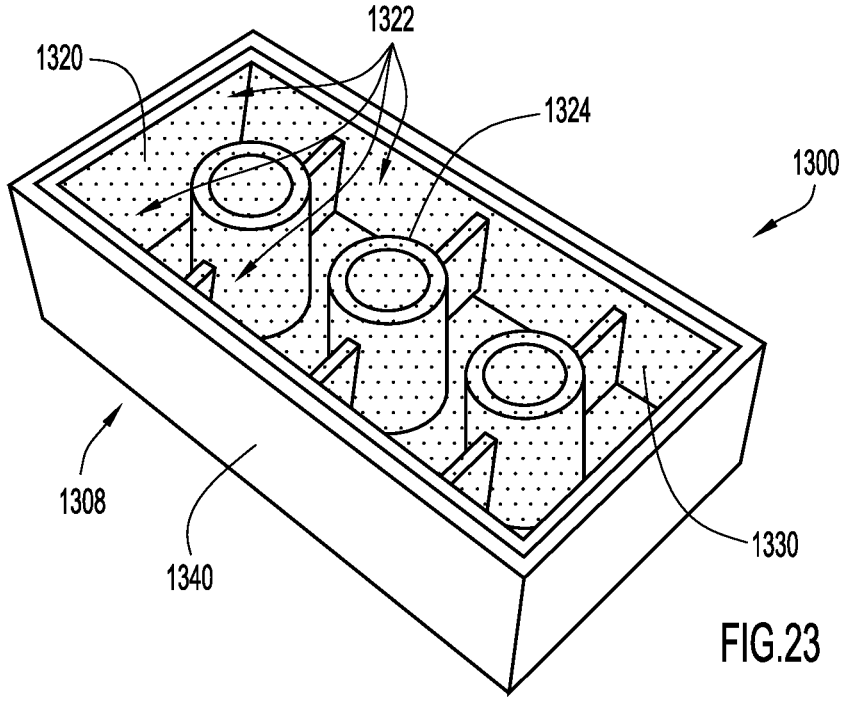

Now turning to FIGS. 22-23, another exemplary toy building component 1300 is shown from top and bottom perspective views, respectively. Similar to toy building component 1100, toy building component 1300 also includes a main body 1308 with a top 1310, a bottom 1320, and an edge 1330 extending around the periphery of both top 1310 and bottom 1320. However, the embodiment shown in FIGS. 22-23 also includes an exterior shell 1340, which substantially encircles or surrounds edge 1330 such that it may form an exterior part of portion of building component 1300.

Still referring to FIGS. 22-23, main body 1308 includes at least one projecting portion 1312 extending from the top 1310 of main body 1308 and at least one receptacle 1322 on bottom 1320. In this particular embodiment, building component 1300 includes eight posts 1312 and eight receptacles 1322, both of which are aligned in a 4×2 configuration. In this particular embodiment, each projecting portion 1312 is cylindrical.

Referring specifically to FIG. 23, similar to the embodiments shown in FIGS. 19-21, edge 1330 of main body 1308 may extend further than the walls 1324 such that the walls 1324 are contained within the building component 1300. Additionally, in this embodiment, the sleeve 1340 may also extend substantially the same distance as edge 1330, such that the main body 1308 appears to be at least partially encased or entrapped within sleeve 1340. That is, the sleeve 1340 may form a continuous protective casing that covers an entire lateral periphery of the main body 1308 so that the main body 1308 is disposed entirely within the lateral periphery defined by the sleeve 1340. However, in other embodiments, sleeve 1340 and walls 1324 may extend beyond the edge 1330 any desirable distance. Alternatively, the edge 1330 may also extend beyond one or both of these features any desirable distance. Regardless of how far each of these features extends beyond bottom 120, the walls 1324 are spaced apart from each other and from edge 1330 so that each aperture 1322 is sized to receive a post 1312 of building component 1300.

In some embodiments, the sleeve 1340 may be referred to as a first portion of building component 1300 and the main body may be referred to as a second portion of building component 1300. Each of the portions may be formed from a different material. For example, in FIGS. 22-23, the main body 1308 is formed from a first, flexible material in order to provide a building component 1300 with flexible coupling portions (i.e. posts 1312 and receptacles 1322) and the sleeve 1340 is formed from a stiff, hard, and/or resilient material in order to maintain the structural integrity of building component 1300. Alternatively, in other embodiments, the first portion of the building component 1300 can be soft to form a protective casing around building component 1300 and the second portion can be formed hard in order to provide rigid coupling portions. In still other embodiments, any part or number of parts may be referred to as the first portion and may be formed from a first material and any other parts or number of parts may be referred to as the second portion and formed from a second material. Regardless, in any of these embodiments, the first and second portions may be co-molded together in order to form building component 300.

Now referring generally to FIGS. 19-23, regardless of whether the projecting portions 1112, 1312 are formed from a soft or hard material, in order to couple multiple building components 1100, 1300 together, each projecting portion 1112, 1312 is aligned and inserted into a receptacle 1122, 1322. Once a projecting portion 1112, 1312 is inserted within a receptacle 1122, 1322, it will contact at least two walls 1124, 1324 or at least one wall 1124, 1324 and at least a portion of edge 1130, 1330 and, thus, be secured within a receptacle 1122, 1322 via a friction fit. However, if the receptacle 1122, 1322, or a portion thereof (such as walls 1124, 1324 or edge 1130, 1330) is formed from a soft or flexible material, the aperture 1122, 1322 may allow for slight misalignments when multiple building components 1100, 1300 are coupled together. Similarly, if a projecting portion 1112, 1312 is formed from a soft or flexible material, it may be able to slightly deform when being inserted into a receptacle 1122, 1322 such that some play or leeway is afforded to the user attempting to couple multiple building components together. More specifically, if one of the coupling portions of building components 1100, 1300 includes a soft, resilient material, as a projecting portion 1112, 1312 is inserted into the receptacle 1122, 1322, the soft, resilient portion may flex, bend, or otherwise move to receive the projecting portion 1112, 1312 and the resiliency of this portion may urge the projection portion 1112, 1312 into engagement with receptacle 1122, 1322.

Exemplary descriptions of the present invention include the following. In one embodiment, a construction assembly comprises a support structure including a base and a plurality of mounting components coupled to and extending outward from the base, the mounting components being spaced apart from each other, the base being flexible so that the base remains in a non-planar configuration; and a plurality of objects coupleable to the building structure, each of the objects being configured to engage at least one of the mounting components to couple the particular object to the base. In one embodiment, each of the mounting components is substantially rigid. In another embodiment, the mounting components are co-molded with the base.

In one embodiment, the mounting components are formed of a different material than the base. The base is sufficiently flexible so that the base is disposable in a substantially cylindrical configuration. In an alternative embodiment, a first mounting component and a second mounting component are coupled to each other via an elongate member. The elongate member includes a first end coupled to a first mounting component and a second end opposite the first end, the second end being coupled to the second mounting component. The elongate member includes a living hinge formed therein. In one embodiment, the elongate member is located within the base.

Alternatively or in addition, each of the first mounting component and the second mounting component includes a connecting portion extending from the base and a base portion coupled to the connecting portion, the base portion of each of the mounting components being larger than the corresponding connecting portion.

In another embodiment, a construction assembly comprises a support structure including a base and a plurality of mounting components coupled to and extending outward from the base, the mounting components being spaced apart from each other, the mounting components being formed from a different material than the base; and a plurality of objects coupleable to the building structure, each of the objects being configured to engage at least one of the mounting components to couple the particular object to the base. In one embodiment, the base is flexible and foldable and the mounting components are substantially rigid.

In an alternative embodiment, a building assembly comprises a support structure including: a base having an upper surface and a lower surface, the base being formed of a flexible material that allows the base to be curved, bent, and rolled; and at least two mounting components coupled to and extending outward from one of the upper surface or the lower surface of the base, the mounting components being spaced apart from each other and configured so that an object can be coupled to at least one of the mounting components to couple the object to the base. The mounting components are formed of a rigid material, and are coupled to the base. Also, the mounting components are co-molded with the base.

It is to be understood that terms such as "left," "right," "top," "bottom," "front," "end," "rear," "side," "height," "length," "width," "upper," "lower," "interior," "exterior," "inner," "outer" and the like as may be used herein, merely described points or portions of reference and do not limit the present invention to any particular orientation or configuration. Further, terms such as "first," "second," "third," etc., merely identify one of a number of portions, components, and/or points of reference as disclosed herein, and do not limit the present invention to any particular configuration or orientation.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A toy building component, comprising:

a first body portion formed from soft, flexible material; and a second body portion formed from a hard, resilient material and coupled to the first body portion, wherein one portion of the first body portion and the second body portion comprises a plurality of mounting components that extend from the other portion of the first body portion and the second body portion, the other portion of the first body portion and the second body portion forms a continuous protective casing that covers an entire lateral periphery of each of the plurality of mounting components, and the one portion is disposed entirely within the lateral periphery defined by the other portion, wherein the first body portion and the second body portion collectively define a top and a bottom, and each mounting component of the plurality of mounting components comprises at least one of:

at least one post extending from the top; and at least one aperture defined on the bottom that is configured to receive a post from another toy building component.

2. The toy building component of claim 1, wherein the continuous protective casing is molded around the plurality of mounting components so that the plurality of mounting components is embedded within the continuous protective casing.

3. The toy building component of claim 2, wherein the first body portion is the plurality of mounting components and the second body portion forms the continuous protective casing around the toy building component.

4. The toy building component of claim 2, wherein the second body portion is the plurality of mounting component and the first body portion forms the continuous protective casing around the toy building component.

5. The toy building component of claim 1, wherein the hard, resilient material of the second body portion defines an edge and one or more interior walls extending away from the bottom, and the at least one aperture is defined between the edge and the one or more interior walls or between multiple interior walls of the one or more interior walls.

6. The toy building component of claim 1, wherein the soft, flexible material of the first body portion defines an edge and one or more interior walls extending away from the bottom, and the at least one aperture is defined between the edge and the one or more interior walls or between multiple interior walls of the one or more interior walls.

7. The toy building component of claim 1, wherein each mounting component extends between the top and the bottom and defines the at least one post and provide walls that define the at least one aperture.

8. The toy building component of claim 7, wherein each mounting component comprises:

a base with an outer perimeter that is larger than an outer perimeter of the at least one post, wherein the walls are included in a lower surface of the base.

9. The toy building component of claim 8, wherein the base further comprises:

an undercut region configured to secure the base between the bottom and the top.

10. The toy building component of claim 8, wherein the base further comprises:

one or more ribs that extends from the walls into the at least one aperture to minimize contact between the at least one aperture and another building block being coupled to the at least one aperture.

11. The toy building component of claim 1, wherein the continuous protective casing includes a plurality of recesses and each mounting component comprises:

an upper end that is disposed a distance above the continuous protective casing; and a lower end secured within one of the plurality of recesses of the continuous protective casing.

12. The toy building component of claim 11, wherein the lower end has an outer perimeter that is larger than an outer perimeter of the upper end and the upper end extends out of a recess of the plurality of recesses, through an opening with an outer perimeter smaller than the outer perimeter of the lower end.

13. The toy building component of claim 1, wherein the hard, resilient material is a plastic material and the soft, flexible material is a rubber material.

* * * * *